US012263416B2

(12) United States Patent
Silfvast

(10) Patent No.: US 12,263,416 B2
(45) Date of Patent: Apr. 1, 2025

(54) ACTION TOY FEATURING OBJECT COLLISIONS INSIDE A VACUUM CHAMBER

(71) Applicant: Robert D. Silfvast, Belmont, CA (US)

(72) Inventor: Robert D. Silfvast, Belmont, CA (US)

( * ) Notice: Subject to any disclaimer, the term of this patent is extended or adjusted under 35 U.S.C. 154(b) by 227 days.

(21) Appl. No.: 18/167,863

(22) Filed: Feb. 12, 2023

(65) Prior Publication Data

US 2024/0269577 A1 Aug. 15, 2024

(51) Int. Cl.

*A63H 33/00* (2006.01)
*A63H 29/24* (2006.01)
*A63H 33/40* (2006.01)

(52) U.S. Cl.

CPC ..... *A63H 33/00* (2013.01); *A63H 29/24* (2013.01); *A63H 33/40* (2013.01)

(58) Field of Classification Search

CPC ..... A63H 33/00; A63H 33/22; A63H 33/40; F41B 11/00; G09B 11/10

See application file for complete search history.

(56) References Cited

U.S. PATENT DOCUMENTS 422,347 A * 2/1890 Hyde ..... F41B 11/00 89/14.6
4,049,367 A * 9/1977 Tominaga ..... B01J 3/08 425/406
5,664,947 A * 9/1997 Dietterich ..... G09B 11/10 434/84
7,219,817 B2 * 5/2007 Panzarella ..... F41B 9/00 222/386
8,074,993 B2 * 12/2011 Andersen ..... F41J 5/24 222/79

* cited by examiner

*Primary Examiner* — John A Ricci

(57) ABSTRACT

An action toy employs a vacuum chamber and vacuum pressure to propel projectiles inward to collide with materials or objects or structures inside the sealed vacuum chamber. Users are entertained by observing high-speed demolition and wrecking action. Air-tight containment of the chamber is required to create a vacuum, ensuring user safety and mess-free operation while providing close-up viewing and video capture from outside the chamber. Users can experiment with a wide variety of high-speed collisions, watch the results in slow-motion replay, and share replay clips with others using a smartphone. The toy can be used to create art works by blasting materials onto a canvas.

20 Claims, 8 Drawing Sheets

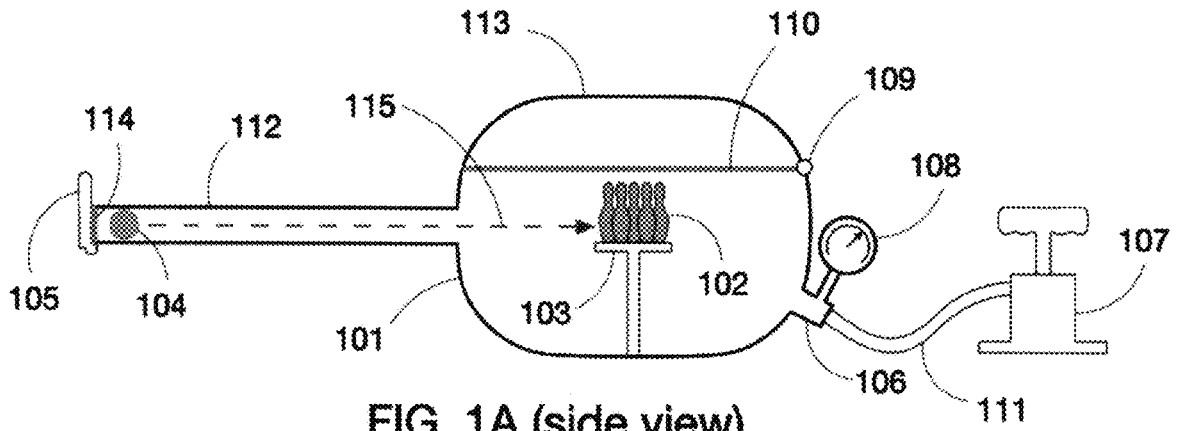
FIG. 1A (side view)
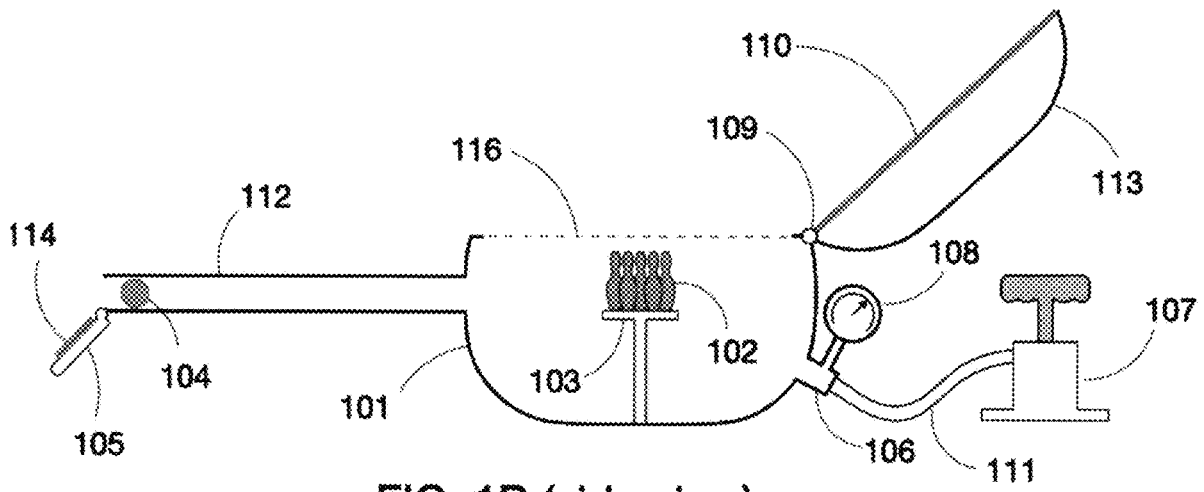
FIG. 1B (side view)
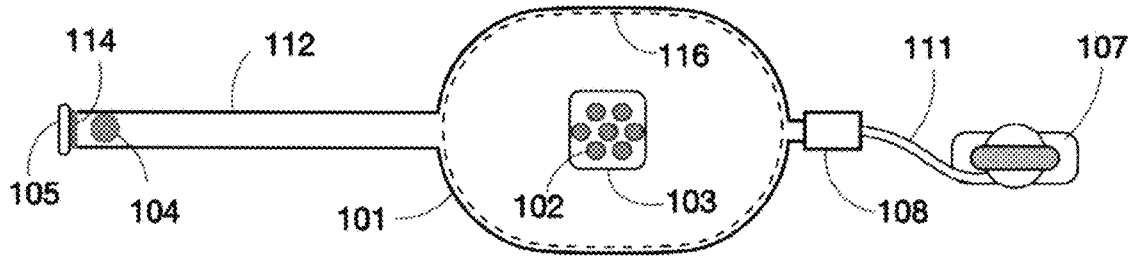
FIG. 1C (top view)

ACTION TOY FEATURING OBJECT COLLISIONS INSIDE A VACUUM CHAMBER

CROSS-REFERENCE TO RELATED APPLICATIONS

This application claims priority to and the benefit of U.S. Provisional Patent Application No. 63/268,001 filed Feb. 15, 2022, the entire disclosure of which is incorporated by reference herein.

FIELD OF THE INVENTION

The invention described herein relates to an action toy apparatus and method of play that involves launching a projectile into a target object or structure of physical materials, for the purpose of causing a high-speed demolition and wrecking action for entertainment purposes. The invention additionally relates to using a smartphone or video camera to capture the action for subsequent replay and sharing, including watching and hearing the demolition action in slow motion.

BACKGROUND OF THE INVENTION

Action toys involving shooting or launching projectiles have been popular for many generations and have been designed and produced in a wide variety of styles and forms. These toys typically launch a projectile in an outward direction from the toy by applying acceleration forces caused by springs, compressed air, fast-spinning rotary mechanisms, or hydraulics.

Action toys based on colliding objects have also been popular for a long time. Examples include cars and trucks designed to collide and break apart into pieces ("Hot Wheels Criss Cross Crash" and "SSP Smash-Up Derby"), and spinning tops that "battle" each other in a fighting ring ("Beyblades" and "Battling Tops").

In both the projectile launching and collision-based toys, users are amused and entertained by observing the high energy of fast-moving objects and/or destructive action. Said another way, "kids love to shoot, smash, and destroy things!"

Many of the toys in these categories are explicitly referred to as guns, and include features and mechanisms associated with real guns, such as pull triggers, bullets or darts (made of soft materials), ammunition magazines, and sights for aiming the gun barrel at a target. Despite the use of soft materials for ammunition, and mechanisms that limit the maximum projectile speeds to safe levels, the usage of toy guns can closely mimic the usage of real guns, and may encourage a form of play that is undesirable. In today's society, with gun violence being a serious and controversial issue, an alternative type of toy that enables a similar high-speed-action play that a toy gun can provide, but without the embodiment of a gun and without mimicking real gun play, may be desirable to many people.

Furthermore, and in general, a toy that provides entertainment through high-speed launching and collision action, while maintaining user safety based on its fundamental design and operation, is likely to satisfy both curious kids and parents alike.

SUMMARY OF THE INVENTION

The present invention utilizes a novel approach to launching a projectile and causing high-speed demolition and wrecking action. Rather than propelling an object in an outward direction from the toy, or smashing energized objects together in an open track or course or fighting ring, the present invention employs a vacuum chamber which serves two primary purposes. First, the vacuum facilitates inward-directed, pneumatic propulsion of a projectile; and second, the sealed chamber ensures complete containment of the ensuing demolition action. A user sets up a target inside the vacuum chamber, then closes the chamber with a sealed lid or door, and then applies pumping action to create negative air pressure inside the chamber. An elongated tube or conduit attached to the chamber and also enclosing the evacuated volume provides a "launch path" for a projectile to travel and accelerate, propelled by the inrush of air produced when a flap at the end of the tube is abruptly opened.

The present invention has a number of attributes that differentiate it from other toys and apparatuses in related prior art.

First, the propulsion force is created by negative air pressure, rather than positive air pressure employed by a typical air-powered gun toy or stomp rocket. The forces resulting from negative air pressure cannot cause an explosion that could cast off objects in an outward direction, potentially causing harm to nearby persons or objects. If a part of the toy were to become weakened by cracking or fracture, the vacuum pressure could not be created, or at worst, the forces would cause the chamber to collapse harmlessly inward. With a vacuum, the maximum air pressure differential is fundamentally limited to atmospheric pressure (about 15 pounds per square inch or PSI), a small amount when compared to positively pressurized objects like CO2 cartridges, or even bicycle tires which typically inflate to levels of 50 to 100 PSI.

Second, containment of the destructive action and ensuing mess is guaranteed by design. The apparatus requires a complete air-locked seal in order to create and maintain negative pressure sufficient to launch the projectile. By keeping the mess contained within the chamber, users and parents alike can be confident that clean-up will be easy. In at least one embodiment of the invention, the chamber components can be cleaned in an ordinary dishwasher appliance.

Third, the barrier that is created by the walls of the vacuum chamber allows the action to be safely observed and recorded from a close-up viewing perspective and from many different angles. Common smart phone cameras can be safely positioned just a few inches away from the action, to capture the demolition in full detail, and especially at a high frame rate to enable slow motion replay. Chamber walls can be made with clear polycarbonate plastic, a common and inexpensive material known for its strength and impact resistance. Polycarbonate is commonly used as a material in making "bulletproof glass." Demolition action may include materials smashing against the chamber walls, ricocheting around inside the chamber, and breaking apart in random and unexpected ways, all of which can be quite fun to watch and listen to in a slow motion replay.

Fourth, the apparatus has a scientific aspect which lends itself very nicely to the educational toy market. Users will learn and apply basic principles of Newtonian physics. In general, the kinetic energy of the projectile when it collides with its target is calculated simply as $E_K=F*D$, where $E_K$ is kinetic energy, F is the vacuum force applied to the projectile (calculated to first order as the vacuum pressure multiplied by the cross sectional areas of the launch tube), and D is the distance traveled by the projectile down the length of the launch tube. The speed of the projectile is calculated from $E_K$=%*M*$V^2$, where V is the velocity and M is the projectile's mass. In one embodiment, the user interface to the apparatus includes calculations of the physical parameters and a sensor for the projectile's speed to be measured and confirmed against the calculations. Users may experiment with different levels of vacuum pressure, projectile mass, and launch tube length, to develop an intuitive understanding of Newtonian physics.

In addition to its usage as a toy for observing wrecking and demolition action, the present invention also can be used to create art works. For example, the interior of the vacuum chamber can be used as a "canvas" upon which materials will splatter, adhere, drip, and settle in unpredictable and interesting patterns, after said materials have been placed inside the chamber and blasted by one or more projectiles. Examples of materials useful in creating this type of "blast art" may include paints, inks, pastes, putties, glues, powders, sand, pebbles, beads, sawdust, grains, and the like. In at least one embodiment of the invention, interior walls of the chamber can be lined with a removable canvas such as paper or cardboard or fabric, such that a work of art created from blasted materials can easily be removed from the chamber for subsequent display and enjoyment.

BRIEF DESCRIPTION OF THE DRAWINGS

FIG. 1A and FIG. 1B are side elevation views of an example apparatus, showing primary functional elements in the system. FIG. 1B shows the apparatus in its opened state, while FIG. 1A shows the apparatus in its closed state. FIG. 1C is a top view provided to show the depth of the example apparatus depicted in FIG. 1A and FIG. 1B.

DETAILED DESCRIPTION OF THE INVENTION

Figure 2A:
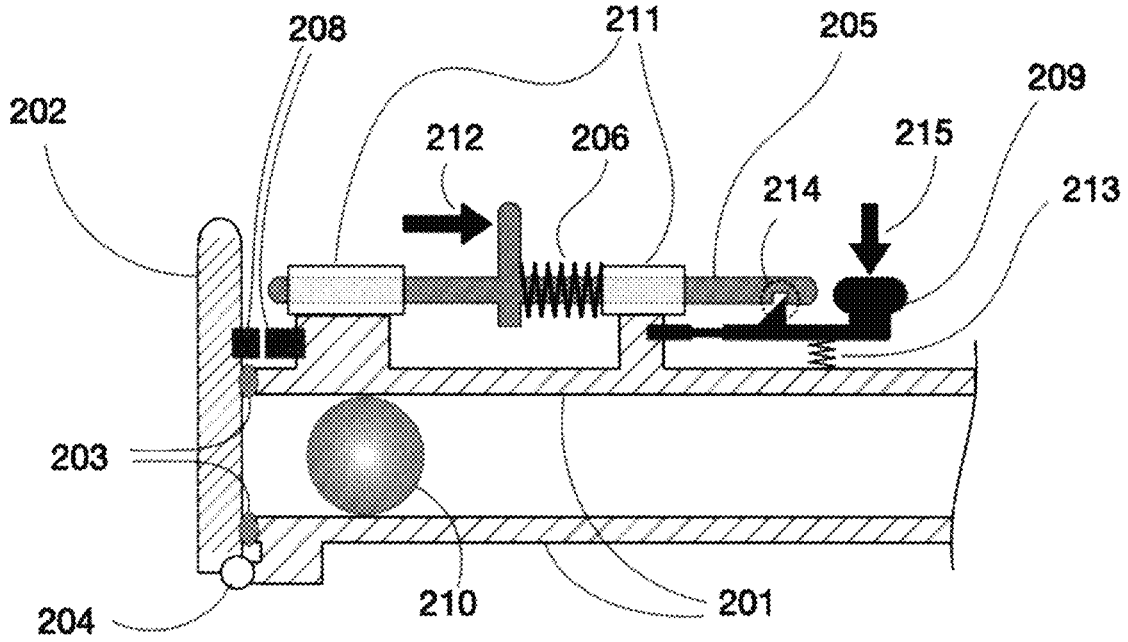
FIG. 2A and FIG. 2B are side elevation close-up views of an example mechanism suitable for launching a projectile.

The following description is provided to enable persons skilled in the art to make and use the described embodiments set forth in the best mode contemplated for carrying out the inventions. Various modifications, equivalents, variations, and alternatives, however, will remain readily apparent to those skilled in the art. Any and all such modifications, variations, equivalents, and alternatives are intended to fall within the spirit and scope of the present invention.

Referring to the side elevation view of FIG. 1A: A vacuum chamber, constructed of a substantially transparent shatter-resistant material such as clear polycarbonate plastic for example, comprises a main body 101 adjoined to a launch tube 112, along with chamber lid 113. The main body, chamber lid, and launch tube together enclose a volume of air which can be negatively pressurized using vacuum pump 107 connected via hose 111 to suction port 106. As oriented in the Figure, launch tube 112 has an inlet end at the left, and an exit end at the right where it adjoins main body 101. The inlet end of the launch tube can be closed by inlet cover flap 105 and sealed airtight by inlet gasket 114. FIG. 1B shows the apparatus of FIG. 1A with the chamber lid 113 and inlet cover flap 105 in their open states, while FIG. 1C shows a top view of the same apparatus with chamber lid and inlet cover flap closed (as in FIG. 1A). As depicted in FIG. 1B, the vacuum chamber can be opened by lifting chamber lid 113 which is attached to the main body 101 by hinge 109 allowing it to swing upward to provide access for the user to set up an impact target 102 on top of impact stage 103. Lid gasket 110 ensures that an airtight seal is maintained when the chamber lid is closed. Dashed line 116 in FIG. 1B, also shown from a top view in FIG. 1C, represents the rim of chamber main body 101, which provides a mating surface for gasket 110 to seal against when chamber lid 113 is in the closed position. With chamber lid 113 in the open position (shown in FIG. 1B), a user sets up an impact target 102 on impact stage 103 which is positioned within the launch path (represented by dashed arrow line 115) created by the orientation of launch tube 112. After setting up an impact target 102, the user closes chamber lid 113 which is then held by gravity against chamber rim 116 and sealed airtight by lid gasket 110. With inlet cover flap 105 opened (as in FIG. 1B), the user then places a projectile 104 into a resting position at the inlet end of the launch tube 112, and closes the inlet with inlet cover flap 105 pressing against inlet gasket 114. With chamber lid 113 and inlet cover flap 105 both closed, the apparatus is ready for depressurization. The user operates vacuum pump 107 to extract air from the chamber through hose 111 attached to suction port 106. Air pressure sensor 108 allows the user to monitor the magnitude of negative air pressure inside the chamber while pumping is underway. Furthermore, as negative air pressure is created inside the chamber, ambient air pressure outside the chamber imposes forces on all the outer surfaces of the chamber and launch tube including chamber lid 113 and inlet cover flap 105, thus causing these components to be pressed against their gaskets, ensuring an airtight seal. Once a sufficient amount of negative air pressure is achieved, the system is ready for launch. To launch the projectile 104, the user causes the inlet cover flap 105 to open abruptly, for example with the swipe of a hand against the flap from right to left in FIG. 1A. As the flap opens, a sudden inrush of air pushes against projectile 104 which occupies most of the cross-sectional area of the launch tube 112. At the same time, the in-rushing air acts as a wedge pushing against the inside surface of inlet cover flap 105, forcing it quickly to a fully-open position, which maximizes the size of the opening and the flux of rushing air into the launch tube. Pushing force from the in-rushing air accelerates the projectile along its launch path 115 and into the impact target 112 at a speed sufficient to cause demolition of the impact target. The transparency of the walls of chamber main body 101 and chamber lid 113 enables the user to view, as well as record with a video camera, the demolition action close-up and from a variety of different angles.

Figure 2B:
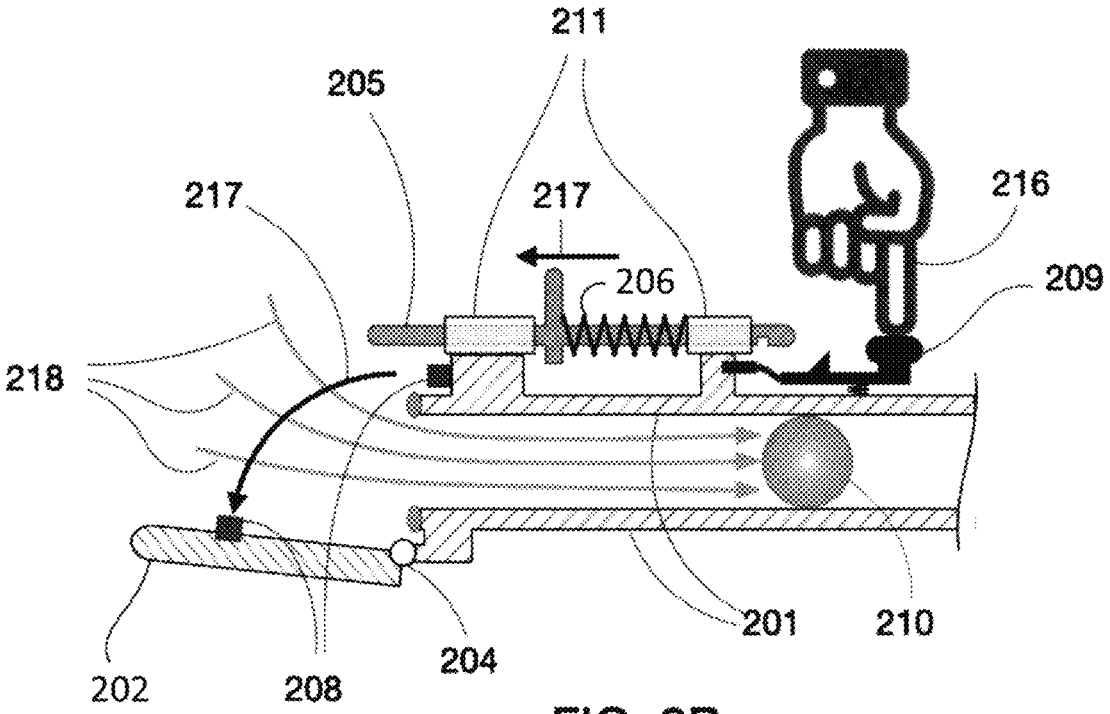

Referring now to FIG. 2A and FIG. 2B, additional details are provided to describe an example embodiment of a launch trigger mechanism associated with the apparatus. Note that FIG. 2A and FIG. 2B show only the inlet end of one possible embodiment of a launch tube, and do not show the exit end of the launch tube and main body of the vacuum chamber, which are described in previous paragraphs and shown in FIG. 1A and FIG. 1B. A key aspect of this example launch trigger mechanism in FIG. 2A and FIG. 2B is that it can store a substantial amount of potential energy in a mechanical spring, and subsequently use that energy to rapidly force open an inlet cover flap at the inlet of the launch tube. The spring can be released using a much smaller amount of energy (compared the potential energy stored in the spring), for example by a finger press or by a kicking force from a solenoid piston powered by a small battery.

Referring to FIG. 2A, launch tube 201 (shown as a cross section) contains projectile 210 and is sealed to support vacuum pressure by inlet cover flap 202 and ring gasket 203. A pair of magnets 208 attract inlet cover flap to inlet end of launch tube, to ensure it stays closed before the vacuum chamber is evacuated. In this example, push rod 205 is captive in sleeves 211 which are hollow cylinders supported by structures built onto launch tube 201, and can slide longitudinally and parallel to the axis of the launch tube 201. When a user slides push rod 205 in the direction of arrow 212, the strong spring 206 is compressed thereby storing potential energy. Trigger-catch mechanism 209, assisted by weak spring 213, catches and retains push rod 205 using the tab and notch marked by dotted circle 214, thereby holding push rod 205 and strong spring 206 in a compressed and energized state, ready for a triggered release. As described previously and illustrated with FIG. 1A and FIG. 1B, the vacuum chamber (adjoined to launch tube 201 but not shown in FIG. 2A) is evacuated after the inlet cover flap 202 is closed and before the launch mechanism is triggered.

FIG. 2B depicts what happens immediately after trigger-catch mechanism 209 is pressed downward by finger/actuator 216. This action requires only a small amount of force because the motion of the trigger catch tab and notch (depicted in dotted circle 214 in FIG. 2A) is perpendicular and orthogonal to the force imposed by the compressed strong spring 206. Once the tab has been pushed out of the notch in the push rod, push rod 205 is free to move laterally, thus immediately the compression force in strong spring 206 drives push rod 205 forcefully against inlet cover flap 202, breaking the vacuum seal and easily overcoming the attraction force of magnet pair 208, thus causing the inlet cover flap to swing abruptly open. Air from outside the apparatus immediately rushes into the launch tube to fill the vacuum, as depicted by arrows 218. The in-rushing air 218 acts as a direct force on projectile 210, thus causing the projectile to accelerate rapidly down the launch tube toward the main chamber.

Figure 3A:
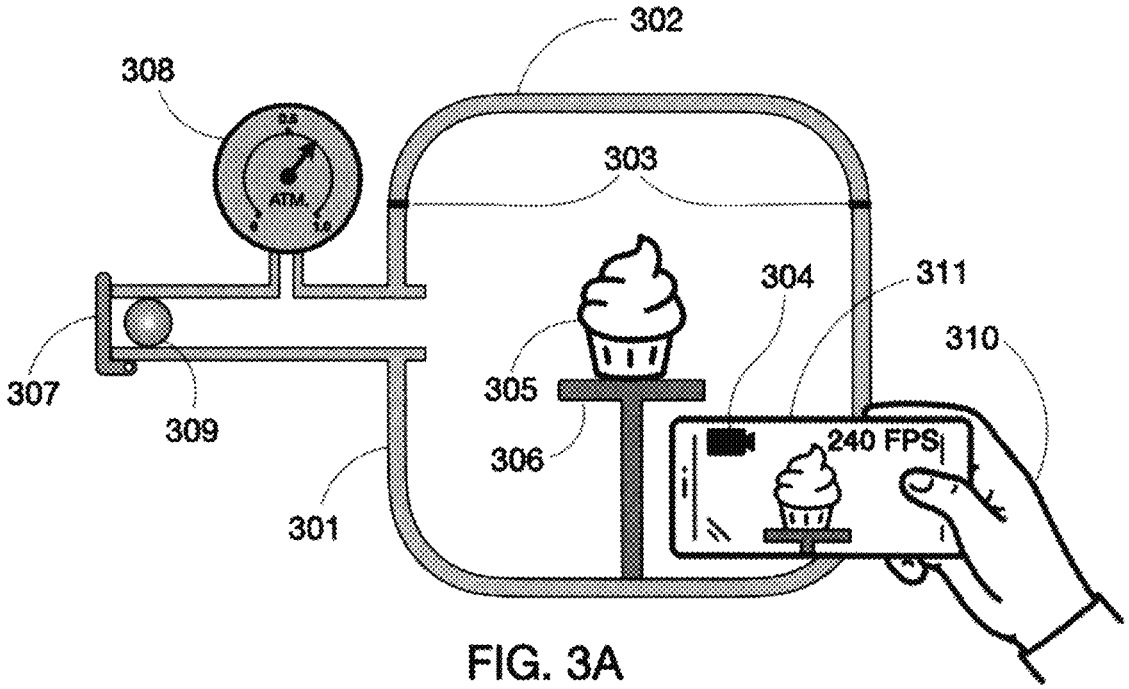
FIG. 3A and FIG. 3B are depictions of a user capturing video footage of the toy in action, using a smartphone.
Figure 3B:
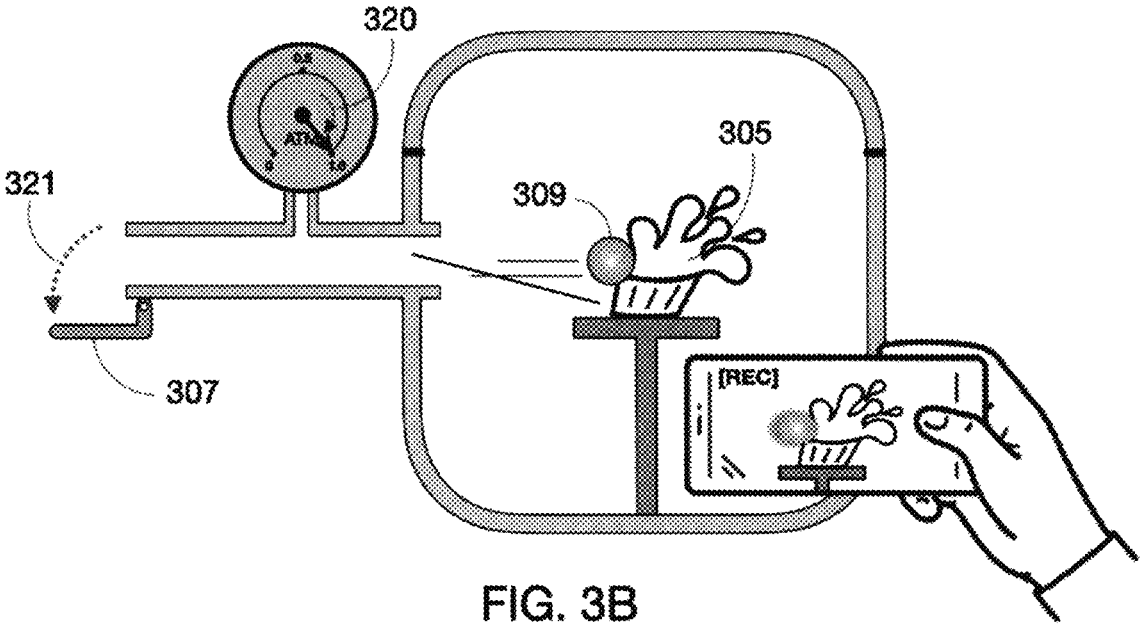

Referring now to FIG. 3A and FIG. 3B, these side elevation illustrations depict a play mode associated with the apparatus in which a user captures video footage of a collision with a smartphone. In FIG. 3A the vacuum chamber 301 (shown as a cut-away view to illustrate the air volume within the chamber) is negatively pressurized substantially below 1 atmosphere, as shown on vacuum pressure gauge 308. The inlet cover flap 308 is closed and sealed, and a projectile 309 is at rest inside the inlet end of the launch tube. Chamber lid 302 is sealed against lid gasket 303. A user 310 positions a smartphone camera 311 to capture close-up footage of the action inside the chamber. The camera is configured for video capture mode (depicted by on-screen icon 304), and for best results the video frame rate is set to a high or maximum rate, as indicated in the figure by on-screen text "240 FPS," where "FPS" abbreviates frames per second. In FIG. 3B the smartphone is actively recording the action, immediately after the inlet cover flap 307 has swung open (triggered by a user as described in previous paragraphs and drawings), and the projectile 309 is colliding with the target object 305. Dotted arrow line 321 depicts the movement of the cover flap swinging open, while dotted arrow 320 depicts the vacuum pressure gauge needle moving toward reading 1 atmosphere of pressure as the inrushing air has filled the vacuum.

By recording the collision from an up-close viewpoint, and at a high frame rate, users can watch replays of the collision in great detail and in slow motion. By using a modern smartphone equipped with media editing apps, social media apps, and Internet connectivity, users can quickly and conveniently edit, enhance, and share these video clips for others to watch and enjoy.

Figure 4A:
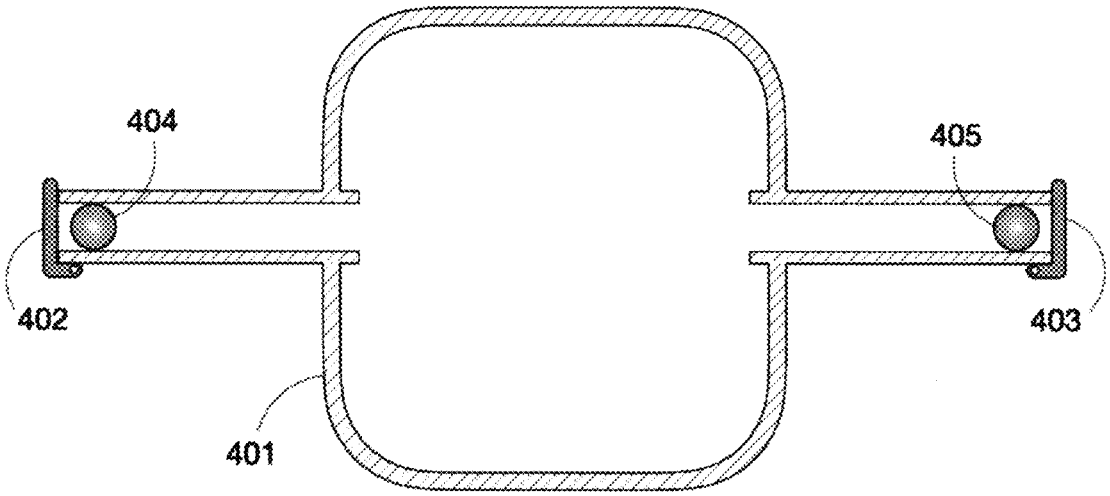
FIG. 4A and FIG. 4B are side elevation views of an alternative embodiment of the apparatus, in which two projectiles are launched toward each other and collide inside the vacuum chamber.
Figure 4B:
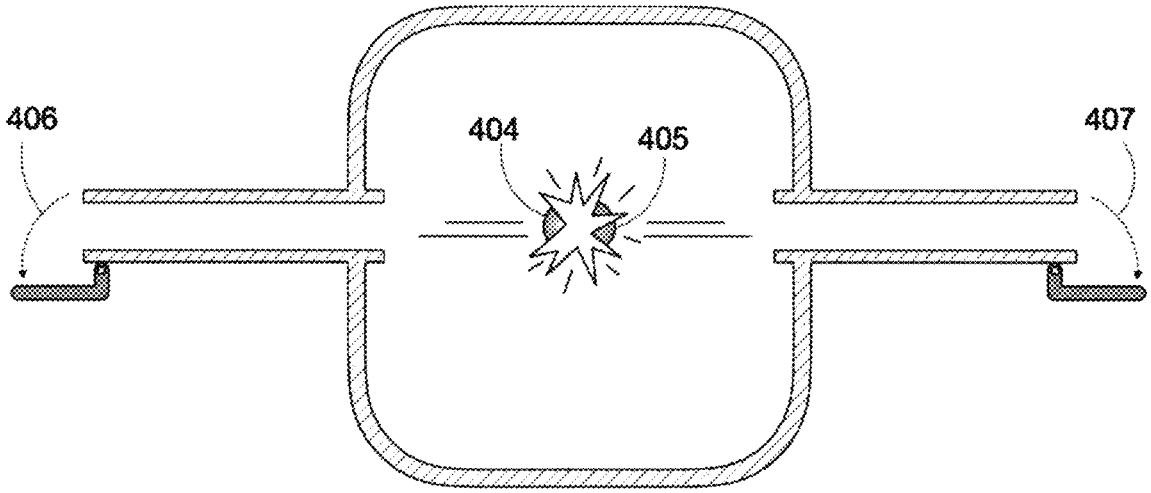

Referring now to FIG. 4A and FIG. 4B, these are simplified illustrations depicting primary aspects of an alternate embodiment of the invention. This embodiment comprises two launch tubes, each having its own inlet cover flap and ability to accelerate a projectile inward toward the main chamber, propelled by the force of in-rushing air. Projectiles may collide with each other, or they may strike a target object simultaneously from different angles to create variety in demolition action within the vacuum chamber. In FIG. 4A, a chamber with two launch tubes is depicted as a cross section outline 401. For simplicity and to highlight the primary idea of this example embodiment, the diagram omits details of a complete apparatus, which have been described in previous paragraphs and figures, such as chamber lid, vacuum pump, vacuum gauge, gaskets, smartphone camera, and trigger release mechanisms for the inlet cover flaps 402 and 403. In FIG. 4A, the system is at rest and the chamber has been evacuated. Projectiles 404 and 405 are poised at the inlet ends of their respective launch tubes, ready to be accelerated into the chamber when the inlet cover flaps are abruptly opened at the same time. FIG. 4B depicts the action immediately after inlet cover flaps 402 and 403 have abruptly swung open (as depicted by dashed arrow lines 406 and 407). Projectiles 404 and 405 have been accelerated by in-rushing air from both launch tubes, and are colliding with each other inside the chamber. In order to cause both projectiles from both launch tubes to accelerate, the two inlet cover flaps must be opened at the same instant, for example within about 5 milliseconds of each other. Because the in-rushing air moves very quickly, the pressure differential between the outside air and the evacuated chamber interior decreases very quickly after either inlet cover flap is opened. For example, if cover flap 402 opens first, and cover flap 403 opens 100 milliseconds later, there will no longer be a significant air pressure differential to supply force to push and accelerate projectile 405 into the chamber at a reasonable speed. Means for synchronizing the opening of the two respective inlet cover flaps may include electromechanical or purely mechanical mechanisms. For example, two solenoids can be actuated by a common electrical pulse signal, causing each solenoid to push a release mechanism that causes its respective inlet cover flap to open. Another means for synchronizing the two flaps could involve a mechanical linkage such as a pair of push rods both connected to a common lever arm, such that each rod pushes open its respective inlet cover flap when the common lever arm is moved.

Upon considering the above descriptions and associated drawings, it will be obvious to persons skilled in the art that this example of an apparatus having two launch tubes, as illustrated in FIG. 4A and FIG. 4B, can be extended to have greater numbers of launch tubes having synchronized inlet cover flaps, to create systems that facilitate collisions involving more than two projectiles.

Upon considering the above descriptions and associated drawings, it will be obvious to persons skilled in the art that plural launch tubes may be adjoined to the main chamber at a variety of different locations and orientations. The launch tubes need not be located on opposite sides of the chamber and oriented toward each other as shown in FIG. 4A and FIG. 4B. For example, an apparatus could have two or more launch tubes attached on the same side of the chamber and oriented substantially parallel to each other. When the inlet cover flaps of the plural launch tubes are simultaneously and abruptly opened, projectiles in each of the launch tubes will race toward the chamber, with the possibility of one arriving at a target first and winning an ultra-high-speed race.

Upon considering the above descriptions and associated drawings, It will be obvious to persons skilled in the art that embodiments of the invention having multiple launch tubes can incorporate impact stages and target objects for projectiles to collide with, as described in prior paragraphs and in FIG. 1A, FIG. 1B, FIG. 2A, FIG. 2B, FIG. 3A, and FIG. 3B. In general, a great many possibilities exist for realizing systems that employ the principles of vacuum propulsion to cause projectiles, objects, and materials of all kinds to collide with each other, causing interesting and unpredictable demolition action that may be fun to observe, and/or to capture on video and enjoy in slow-motion replay.

Figure 5A:
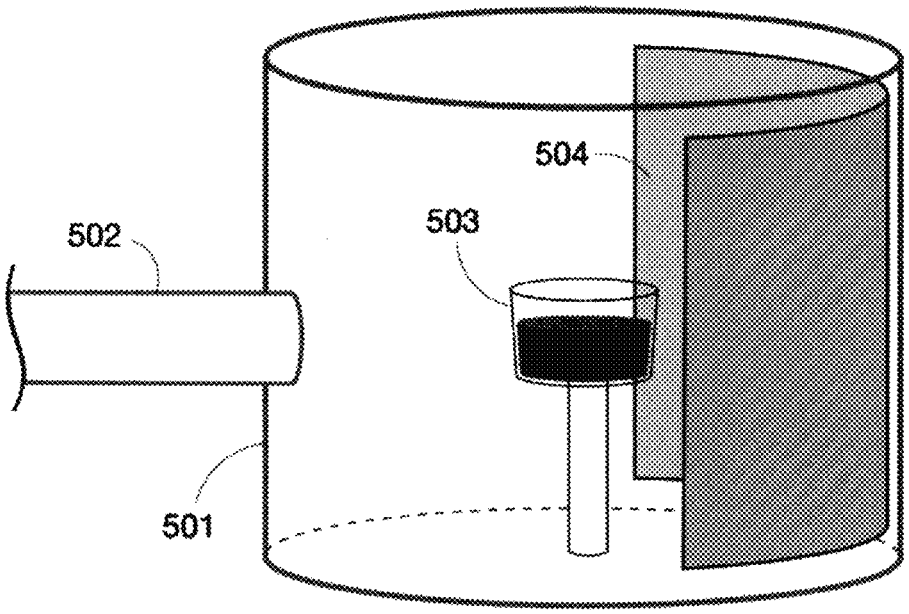
FIG. 5A and FIG. 5B are depictions of how an example apparatus can be used to create artworks, for example by splattering a liquid substance onto a canvas.
Figure 5B:
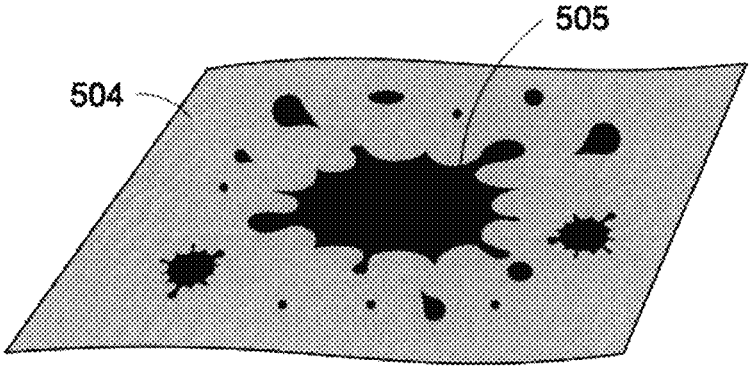

Referring now to FIG. 5A and FIG. 5B, we depict an alternate usage of the apparatus to create art works by capturing splattered materials from a collision inside the chamber onto a canvas. In these figures, details of the apparatus such as chamber lid, inlet cover flap, gaskets, projectile(s), vacuum pump, and smartphone are omitted, as these have been described in sufficient detail in prior paragraphs and figures in this disclosure. FIG. 5A shows a chamber 501 adjoined by a launch tube 502 (note, only the exit end of the launch tube is shown here). Inside the chamber a vessel 503 holds one or more materials such as paint, ink, goop, particles, etc. Prior to the evacuation of chamber 501, an operator places a canvas object 504 against an interior surface of the chamber. The chamber is then closed and sealed. A projectile is positioned at the inlet end of the launch tube (not shown in the figure). Vacuum pumping is applied as described in prior paragraphs and figures in this disclosure. When the vacuum is released to cause impact inside the chamber, materials are cast onto the canvas object 504, typically creating random patterns with interesting features. FIG. 5B shows the canvas object 504 after being removed from the chamber, now covered with a pattern of splatter 505. A user may decide to let the canvas dry (or otherwise settle into a more permanent form) and then put it up for display and enjoyment as a work of art.

In the making of art works as described above, a user may alternatively, or additionally to the usage of a vessel poised on an impact stage as in FIG. 5A, employ projectiles comprising a capsule or vial containing liquid, gel, powder, beads, or other materials which will splatter or become deconstructed on impact. In this scenario, the art work captured by the canvas may include materials from both the projectile(s) and/or the impact target with which the projectile collides.

For the purpose of clarity in this disclosure, and to generalize the various types of materials, objects, or structures that a user may place into the vacuum chamber to create art works as described above and illustrated in FIG. 5A and FIG. 5B, the term "canvas object" is used in the Claims to refer to any physical item upon which splattered, scattered, or deconstructed materials are deposited as the result of a collision within the vacuum chamber. A "canvas object" may be comprised of paper, cardboard, textiles, plastic, rubber, wood, ceramic, stone, metal, or combinations of materials, and may have any variety of shape and size, ranging from a simple sheet to any form of three-dimensional structure.

Figure 7:
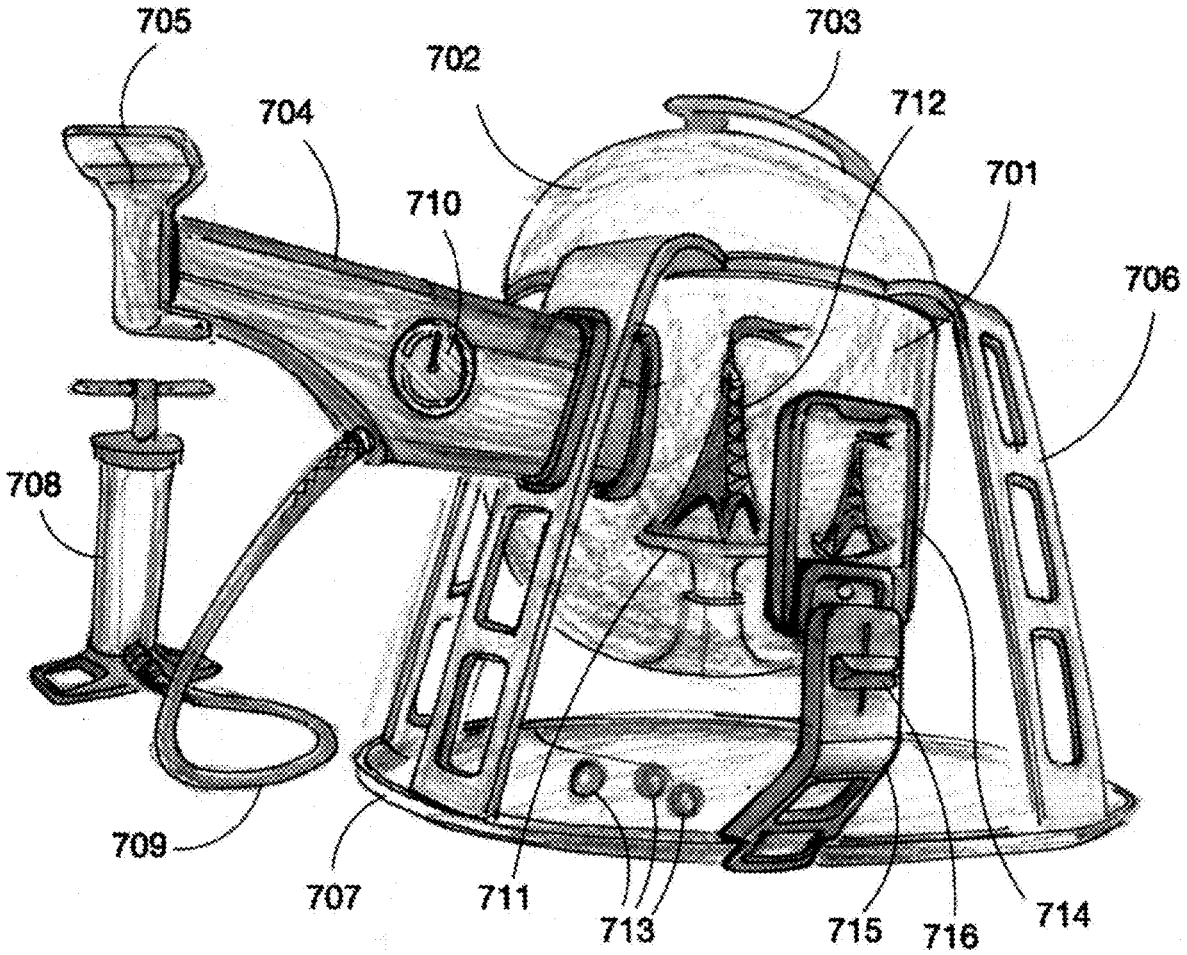
FIG. 7 is an isometric sketch showing an example of a toy system complete with vacuum chamber and launch tube, vacuum pump, and smartphone.

Now referring to FIG. 7, we show an isometric sketch of a complete system in a format that may help the reader to visualize one possible example of a real apparatus. In this sketch, main chamber 701 is supported by framework 706 perched on top of a round base tray 707. Chamber lid 702 can be easily removed and placed back onto main chamber 701 by a user grabbing onto lid handle 703. Launch tube 704 is adjoined to main chamber 701 and supported by framework 706, and incorporates both a launch path for projectiles (along and inside the upper portion of the launch tube) and a suction path for vacuum pumping through hose 709 connected to pump 708. A vacuum pressure gauge 710 is also built into the launch tube, allowing the user to easily monitor pressure when using the apparatus. Inlet cover flap 705 is attached to launch tube 704 with a simple hinge at the bottom, and can be abruptly swung open with a swipe of the hand after the chamber has been depressurized. Gaskets to ensure air-tight seals are included at the interface of the lid to the main chamber, and at the interface of the inlet cover flap to the launch tube; however these are not explicitly depicted in the sketch. A smartphone 714 is supported by camera support structure 715 which includes a slider 716 for adjusting the position of the camera. Furthermore, the support structure 715 may be attached to the rim of the round base tray 707 at many possible locations (the details of its attachment mechanism are not explicitly shown in the sketch). The base tray 707 may be used to hold and store projectiles 713 or other materials such as impact target objects. In this sketch, an impact target 712 is poised on impact stage 711, and it appears on the screen of smartphone 714 as the camera is prepared to capture video of impact and demolition action. The impact target may be constructed of parts or materials that are prone to breaking apart and scattering upon impact, thereby creating high-speed demolition and wrecking action that users will find interesting to observe, and optionally to capture with a high-frame-rate video camera, and to replay in slow motion.

In general, the term "projectile" in this disclosure refers to any object or material or assemblage of materials which accelerates down the launch tube in response to the in-rushing air resulting from abrupt opening of the inlet cover flap. Projectiles may take on a wide variety of forms, including solid objects, soft objects, sets of multiple objects or combinations of objects, and containers that hold liquids or foams or gels or powders, or other materials that splatter or separate upon impact. Standard paintballs may be used as projectiles in some embodiments of the present invention.

In general, a projectile that occupies most or all of the cross-sectional area of the launch tube will receive the maximum amount of force from the in-rushing air, and therefore will incur maximum acceleration. Therefore, it is advantageous to use projectiles that are properly sized and shaped; for example, if the launch tube has a rectangular cross section 2 cm wide by 1 cm high, then a projectile with rectangular cross section 1.9 cm wide by 0.9 cm high would likely work well. The sizing and texture of projectiles should be chosen to avoid causing friction when moving down the launch tube, because friction will act against the intended acceleration forces (caused by the in-rushing air) and reduce the projectile's final speed.

Regarding projectiles taking on a variety of forms, in at least one embodiment, a projectile may comprise a cylindrical type of container open at one end and holding foam or gel or liquid (for example, shaving cream or ketchup or slime). Such a projectile may be used in conjunction with a launch tube having a stopper mechanism affixed at the exit end of the launch tube. The stopper mechanism is designed such that when this "filled container projectile" accelerates and reaches the exit end of the launch tube, the stopper mechanism blocks the container from traveling into the main chamber, while allowing the contents of the container to continue traveling (due to their momentum) out of the open end of the container and into the main chamber at high speed. In at least one embodiment of this container-type of projectile, the container has a thin cover material (such as foil or plastic film) on one end to hold the contents inside the container before launch; but such cover material is weak enough to allow the contents to break through and continue traveling when the container hits the stopper mechanism at high speed. The benefit of this type of projectile is that it can release non-solid materials and cast them at high speed onto a target object, for example to carry out a version of the well-known "pie in the face" trick; this can be fun and enjoyable to watch, especially in slow motion.

Figure 8A:
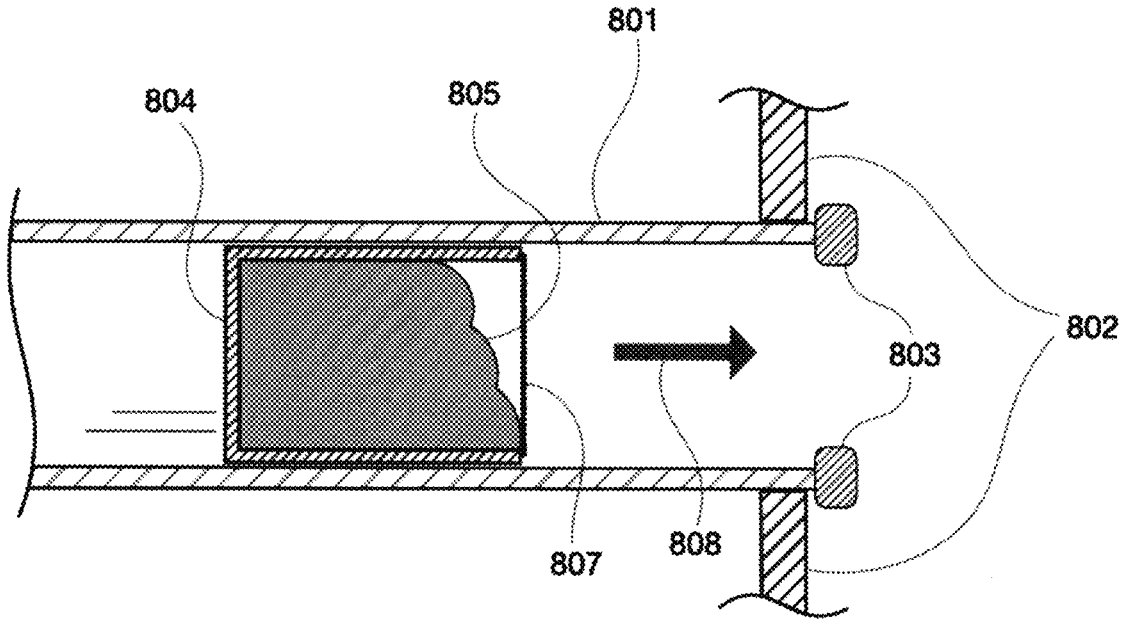
FIG. 8A and FIG. 8B are depictions of a type of projectile that empties its contents into a chamber when it encounters a stopping mechanism at the end of a launch tube.
Figure 8B:
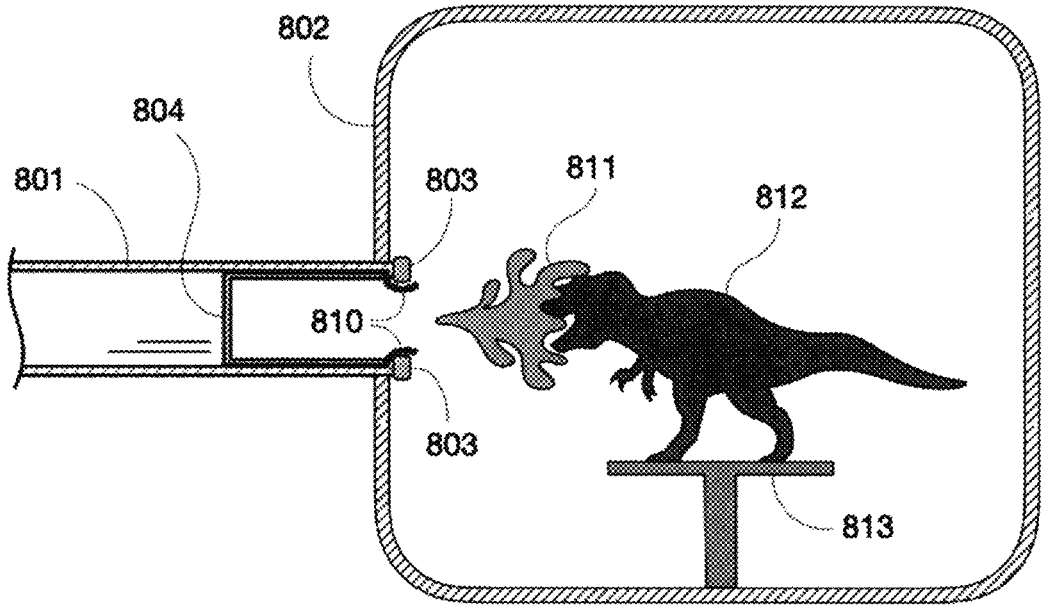

Referring now the FIG. 8A and FIG. 8B, we show an example of an apparatus set up to carry out a "pie in the face" type of collision as described above. These illustrations are drawn as cross sections to highlight the stopper mechanism and the structure of the projectile. Launch tube 801 is adjoined to a wall 802 of a vacuum chamber. Stopper mechanism 803 comprises a solid ring that is attached to the exit end of the launch tube, and has a smaller inner diameter than the inner diameter of the launch tube. A projectile assembly comprises a hollow cylindrical vial 804 filled with a splatter-capable material 805, for example shaving cream or whipped cream. If needed to hold the splatter-capable material inside the vial prior to launching the projectile assembly, a breakable cover layer 807 may be affixed to the open end of the vial; this cover layer may be comprised of a thin film of foil or paper, for example. Upon release of vacuum pressure to cause a launch, this projectile assembly travels down the launch tube from left to right in the figure (this motion is depicted by arrow 808) until the vial 804 meets the stopper ring mechanism 803, thereby blocking the vial from traveling into the chamber. FIG. 8B depicts the action that ensues immediately after the projectile assembly has collided with the stopper mechanism 803: The splatter-capable material continues to travel from left to right, due to its momentum, breaking through the breakable cover layer if present (shown as 810 in FIG. 8B), and splatters onto any objects or surfaces inside the chamber. In FIG. 8B the vial 804 is now empty, the broken cover layer 810 has given way, and the splatter-capable material 811 is splattering onto an impact target 812 (in this example a dinosaur figurine) perched on impact stage 813. A user may choose to capture video of the action described above and subsequently enjoy watching it back in slow motion.

A stopper mechanism may be detachable from the end of the launch tube, to accommodate projectile types that are not intended to stop abruptly and empty their contents into the chamber as described above and illustrated in FIG. 8A and FIG. 8B.

Note that breakable cover layer may not be needed to hold contents inside the vial, even if the splatter-capable material is a liquid. For example, if the launch tube is oriented vertically, with its inlet end at the bottom, and its exit end at the top, then liquid contents would be kept inside the vial due to gravity.

It should be clear from the descriptions and drawings in this disclosure that the present invention facilitates a very wide range of possibilities for experimenting with collisions involving many different materials and objects and structures. In fact, a key aspect of the invention is that it provides an "open platform" for experimentation, enabling a highly creative form of play that stimulates imaginations and promotes discovery and learning. Therefore it should be especially clear to persons skilled in the art that the specific drawings and descriptions in this disclosure represent just a few examples of possible embodiments of the present invention. The crucial and unique aspect of the invention is using vacuum pressure to propel objects or materials inward to collide in interesting ways inside of a sealed vessel.

In one or more embodiments of the present invention, the launch tube is a modular component that can be easily removed from the main chamber. Such modularity facilitates easy disassembly for cleaning the main chamber in a kitchen sink or household dishwasher appliance. Such modularity also facilitates interchanging the launch tube with a different design, for example to have a larger cross section for experimenting with larger sized projectiles. Modularity and easy attachment and detachment of the launch tube from the main chamber can be facilitated for example using a twist-lock mechanism, or a threaded screw mechanism, or other fastening mechanism designed to produce an air-tight seal when the launch tube is attached.

Figure 6:
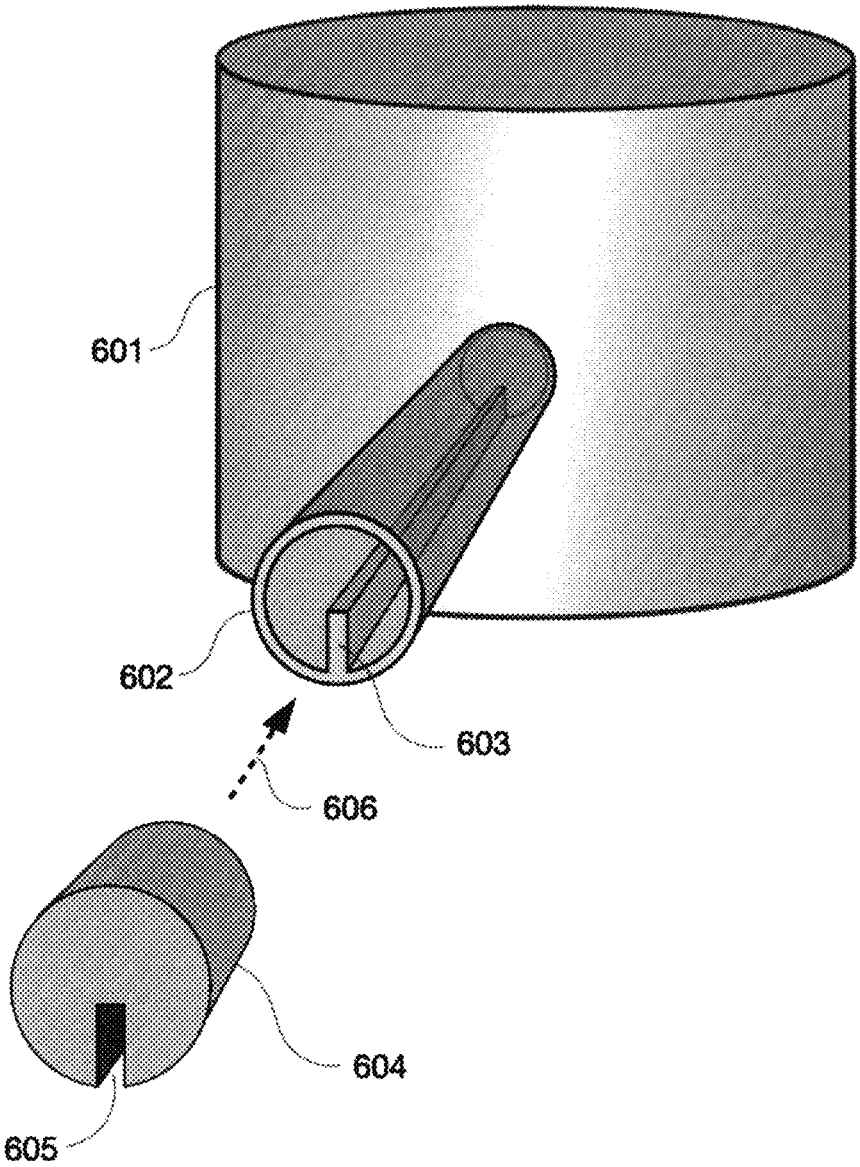
FIG. 6 is an isometric view depicting an example of a keyed launch tube and a matching keyed projectile, one type of safety mechanism which can be employed by the apparatus.

As described in previous paragraphs, the fundamental operating principle of the apparatus ensures that users will be protected from the high-energy action and mess that occurs during a collision, because the chamber must be fully enclosed and sealed air-tight to support a vacuum pressure differential. Nonetheless, it is prudent to consider safety as an important element of any product that is marketed as a toy intended for kids. In this regard, a number of safety mechanisms can be added to the basic apparatus, including but not limited to the following:

1. The launch tube has a keyed profile which prevents common-shaped objects from being inserted as projectiles and benefitting from the full force of the vacuum. FIG. 6 shows an example of a keyed launch tube and a matching projectile. Referring now to FIG. 6, a launch tube 602 is adjoined to vacuum chamber 601 and has a keyed feature 603 in its cross-sectional geometry. Projectile 604 has a matching feature 605 in its cross-sectional geometry, such that the projectile fits into the launch tube (inserted along the path of dotted arrow 606) occupying a maximal portion of the launch tube's cross sectional open area, and also the projectile is able to slide down the launch tube with no obstructions and with minimal friction.
2. Projectiles, keyed or otherwise, are made of soft materials, or of materials that will not shatter to produce sharp edges.
3. The apparatus includes a pressure relief valve that limits the maximum amount of vacuum pressure that can be attained inside the chamber when evacuation means, such as pumping, are applied by the user.

4. The product is sold with a vacuum pump that cannot produce more than a certain maximum pressure (this is generally the case for low-cost plastic pumps).
5. Sensors that detect the presence of certain objects (such as a live animal) inside the chamber, coupled with a safety interlock that prevents the device from operating when such objects are present. One such sensor can utilize computer vision algorithms running on the smartphone that is used to capture video of the collision. Upon detecting a non-desired object in the chamber, the smartphone could use software and electronic communication with the apparatus to ensure the device cannot launch a projectile at substantial speed.

One or more embodiments of the present invention may include electronic and/or wireless communication technologies to facilitate operation of the apparatus to enhance convenience to the user and/or to create a richer play experience. For example, a smartphone app may provide a user interface to monitor and display the vacuum pressure inside the chamber, to trigger the launch mechanism (via an on-screen "fire button" for example), to monitor and display the speed of projectiles, or to measure and display parameters associated with the collision energy such as visual complexity, scattering velocity, size of debris field, etc. A smartphone app may additionally include features to support video capture, for example a viewfinder window, a start/stop button, and ability to monitor and/or change settings of the camera such as frame rate, exposure levels, zoom level, and the like. In capturing video of a launch and impact event, a user may typically position the smartphone while looking at its screen to obtain a desired viewing angle, and then hold the phone steady to maintain proper image alignment and focus; therefore a fire button on the screen allows the user to launch the projectile with a simple tap of a thumb or finger while maintaining focus on the camera's view. To facilitate communication between mechanisms on the apparatus (such as a small solenoid to trigger the launch, or a speed sensor made with photo-interrupter components), a common wireless communication technology such as Bluetooth may be built into the apparatus. A microcontroller also built into the apparatus may translate between operations of mechanisms on the apparatus, such as sensors and triggers, and Bluetooth communication packets flowing between the apparatus and a smartphone.

One or more embodiments of the present invention may include addition of lighting effects, such as strobe lights, to enhance the visual appeal of the collision action and the footage captured by a camera. Such lighting affects may be triggered by the launch mechanism, or by a smartphone app, and may be synchronized with the moment of launch, or with the moment of impact, and/or with the shutter of the camera, to maximize the quality and richness of the video footage captured throughout the collision, the ensuing demolition of objects or materials, and the aftermath of the event.

One or more embodiments of the present invention may include addition of sound capture elements to enhance the sonic appeal of the collision action when played back from captured footage. Acousto-electric transducers, such as microphones or piezoelectric contact pickups or accelerometers, may be installed inside the apparatus, or attached elsewhere on the apparatus to pick up sound emitted by the collision, the wrecking action, and the settling of materials that ensues after the collision. When such sounds are captured and played back at a slower speed (e.g. along with the slow-motion video playback), they can be quite interesting and pleasing to hear as a key element of the slow-motion "replay." Furthermore, smartphones are known to have sophisticated audio editing and processing functionality; this makes it possible to quickly and easily modify and enhance the sounds of the collision to create an even more interesting "video clip" than can be produced simply by playing back the raw capture sound waveforms at a lower speed.

In most of the descriptions above, the abrupt vacuum release required to propel a projectile down the launch tube has been described as an inlet cover flap. In FIG. 2A and FIG. 2B, a mechanism was described to show one possible embodiment of a trigger mechanism to open an inlet cover flap. It will be apparent to persons skilled in the art that different types of mechanisms may be designed and employed with the apparatus to enable abrupt release of the vacuum and cause the in-rush of air that forces a projectile down the launch tube. Examples of different types of mechanisms may include valves, shutters, electromagnets, ball-in-socket mechanisms, pistons, and all other known types of mechanical flow switches. Such mechanisms can be manually operated or assisted by electronic, electro-magnetic, pneumatic, or hydraulic actuation. In at least one embodiment, a flat rubberized pad can be manually held against the end of the launch tube while vacuum is applied; the pad will be held in place on its own by suction force once sufficient vacuum is achieved, and it can be abruptly opened with a swipe of a hand to trigger a launch. For the purposes of this disclosure, and to generalize the various vacuum-release mechanisms contemplated within the scope of the present invention, the term "air-inlet valve" will be used in the Claims to refer to any mechanism that can rapidly transition from holding a vacuum seal to allowing air to rush through with substantial flux at or near the inlet end of a launch tube.

In one or more embodiments of the present invention, the launch tube may be constructed of flexible material, such as the hose commonly used with a household vacuum cleaner or an inflation pump. It is not required that the launch tube be rigid as shown in FIG. 1A and FIG. 1B. For the purposes of clarity, the term "launch tube" in this disclosure refers to any conduit that leads from an air-inlet opening to the main chamber of the apparatus, and has a cross sectional shape that is suitable for guiding a projectile rapidly toward and into the main chamber under the forces of inrushing air from the inlet end of the conduit. In one or more embodiments of the present invention, the launch tube can have substantial length and/or curvature, to provide a long pathway for a projectile to travel and accelerate due to the force of inrushing air. Such a launch tube may be transparent, enabling the user to watch the projectile travel a long and crazy course reminiscent of a Rube Goldberg machine or of the "Krazy Straw" product that was a popular fad in the 1970's. A launch tube need not be oriented horizontally as shown in the figures accompanying this disclosure. Launch tubes may be oriented at any angle (in addition to having straight or curved shapes), thus creating paths for projectiles to travel in any combination of X, Y, or Z directions to travel into the chamber from their initial positions prior to launch.

In one or more embodiments of the present invention, the main chamber may comprise plural sections, and therefore have the appearance of plural chambers. Complex shapes for chambers may be used to create a more diverse range of possibilities for materials and objects to ricochet, scatter, and travel around inside the apparatus as the result of a collision. For the purposes of clarity, the term "chamber" in this disclosure refers to any enclosed volume of any shape, and having any type of internal structures or features that may facilitate "obstacle course" or "high-speed Rube Goldberg machine" types of actions and reactions among objects and materials within the chamber. In one or more embodiments, users may construct vacuum chambers from modular components fitted together with air-tight seals, resulting in custom and unique shaped machines that users can use to collide and smash objects, and observe the results.

What is claimed is:

1. A method for facilitating an entertainment experience comprising the steps of placing one or more materials or objects within the interior of an opened vacuum chamber having one or more launch tubes each fitted with an air-inlet valve, said one or more materials or objects located within a said launch tube on the interior side of said air-inlet valve, followed by closing said vacuum chamber with an air-tight seal to prepare said vacuum chamber for evacuation, followed by evacuating air from said vacuum chamber to produce a substantial pressure differential inside said vacuum chamber relative to its exterior environment, followed by abruptly opening at least one of said air-inlet valves to produce an in-rush of air into said launch tube thereby directing force onto said one or more materials or objects placed inside said launch tube thereby accelerating said one or more materials or objects to produce a collision inside said vacuum chamber.

2. The method of claim 1, further including placing one or more target objects inside said vacuum chamber prior to evacuation, such that said collision involves said one or more accelerating materials or objects striking said one or more target objects.

3. The method of claim 1, further including using a video camera to record footage of the action produced by said collision, followed by replaying the recorded video footage in slow motion.

4. The method of claim 3, wherein said video camera is built into a smartphone, and said recorded video footage is edited using one or more apps running on said smartphone.

5. The method of claim 3, wherein said video camera is built into a smartphone, and said recorded video footage is shared via a network connection from said smartphone.

6. The method of claim 1, wherein said collision causes dispersion of materials onto a canvas object which is subsequently saved as an art work.

7. An apparatus comprising a chamber having an interior volume and means for said interior volume to be isolated from its exterior environment by an air-tight barrier, and one or more launch tube sections adjoined to said chamber, each having an inlet end away from said chamber and an exit end adjoined and open to said chamber's interior volume, and each having means to be closed or open at its inlet end via an air-inlet valve, and means for an operator to place one or more projectiles inside any of the one or more launch tube sections, on the interior side of said launch tube section's air-inlet valve, and means to evacuate air from said chamber thereby producing an air pressure differential between said exterior environment and said interior volume when all of said air-inlet valves are closed, and means to abruptly open at least one of said one or more air-inlet valves, resulting in said one or more projectiles accelerating into said chamber by the force of in-rushing air caused by said pressure differential.

8. The apparatus of claim 7, wherein said chamber is made of a substantially transparent material, thereby allowing an operator to view the action produced by said one or more projectiles colliding with objects, materials, or surfaces inside said chamber.

9. The apparatus of claim 7, wherein the construction of said chamber includes one or more viewing windows made of substantially transparent material, thereby allowing an operator to view the action produced by said one or more projectiles colliding with objects, materials, or surfaces inside said chamber.

10. The apparatus of claim 7, wherein the means to abruptly open any of said air-inlet valves is triggered by an electrical signal applied to a solenoid.

11. The apparatus of claim 7, wherein the means to abruptly open any of said air-inlet valves is triggered by the release of potential energy stored in a mechanical spring.

12. The apparatus of claim 7, wherein the means to abruptly open any of said air-inlet valves is triggered by a pneumatic actuator.

13. The apparatus of claim 7, wherein any of said air-inlet valves comprises a hinged flap which can be opened by a user striking said hinged flap.

14. The apparatus of claim 7, wherein

The triggering means to cause abrupt opening of any of said air-inlet valves is initiated from the user interface of a smartphone, said smartphone being in communication with said apparatus.

15. The apparatus of claim 7, wherein said launch tube section has a keyed profile which restricts the shape of projectiles that fit snugly into said launch tube.

16. The apparatus of claim 7, further including electronic means to measure the speed of a projectile and provide an indication of said measured speed to a user.

17. The apparatus of claim 7, further including a structure inside said chamber suitable for supporting one or more target objects and locating at least one of said one or more target objects substantially within the path of a projectile.

18. An apparatus for creating art works, comprising a chamber having an interior volume and means for said interior volume to be isolated from its exterior environment by an air-tight barrier, and one or more launch tube sections adjoined to said chamber, each having an inlet end away from said chamber and an exit end adjoined and open to said chamber's interior volume, and each having means to be closed or open at its inlet end via an air-inlet valve, and means for an operator to place one or more projectiles in any of the one or more launch tube sections, on the interior side of said launch tube's air-inlet valve, and means to evacuate air from said chamber thereby producing an air pressure differential between said exterior environment and said interior volume when all of said air-inlet valves are closed, and means to abruptly open at least one of said one or more air-inlet valves, resulting in one or more of said projectiles accelerating inward into said chamber by the force of in-rushing air caused by said pressure differential, thereby causing a collision that results in dispersion of materials onto surfaces inside said chamber, and means to capture and save the resultant dispersed materials as an image or as a physical art work or as both an image and a physical art work.

19. The apparatus of claim 18, including means for an operator to place one or more removable canvas objects inside said chamber prior to evacuation such that materials dispersed as a result of said collision adhere to said one or more removable canvas objects.

20. The apparatus of claim 18, wherein said materials disbursed onto surfaces inside said chamber include non-toxic paint.

* * * * *